United States Patent [19]

Brockett, III et al.

[11] 3,975,054

[45] Aug. 17, 1976

[54] UNDERSEA MINING AND SEPARATING VEHICLE HAVING MOTOR-POWERED WATER JET

[75] Inventors: Frank Howard Brockett, III; James E. Philp, both of Bellevue; Arthur Francis Sullivan, Redmond, all of Wash.

[73] Assignee: The International Nickel Company, Inc., New York, N.Y.

[22] Filed: Dec. 11, 1974

[21] Appl. No.: 531,754

[52] U.S. Cl. ..... 299/8; 37/57; 37/62; 37/DIG. 8

[51] Int. Cl.[2] ..... E02F 3/94; E02F 7/00

[58] Field of Search ..... 299/8, 9; 37/55, 57, 37/58, 59, 61–63, 195, DIG. 8

[56] References Cited

UNITED STATES PATENTS

| | | | |
|---|---|---|---|
| 1,270,142 | 6/1918 | Gage, Sr. | 37/63 X |
| 3,010,232 | 11/1961 | Skakel et al. | 37/57 X |
| 3,305,950 | 2/1967 | Hirshman et al. | 37/DIG. 8 |
| 3,310,894 | 3/1967 | Ball | 37/195 |
| 3,462,858 | 8/1969 | Francklyn | 37/55 |
| 3,556,598 | 1/1971 | Smith | 37/57 X |
| 3,588,174 | 6/1971 | Rossfelder et al. | 37/57 X |
| 3,624,932 | 12/1971 | Doyle | 37/55 |
| 3,731,975 | 5/1973 | Lindelof | 299/8 |
| 3,802,740 | 4/1974 | Sullivan | 37/57 X |
| 3,842,521 | 10/1974 | Faldi | 37/57 |

FOREIGN PATENTS OR APPLICATIONS

| | | | |
|---|---|---|---|
| 1,156,547 | 6/1969 | United Kingdom | 37/55 |

*Primary Examiner*—Clifford D. Crowder
*Attorney, Agent, or Firm*—George N. Ziegler; Ewan C. MacQueen; Raymond J. Kenny

[57] ABSTRACT

Vehicle constructed for being towed along undersea floor area where desired mineral aggregates, such as manganese nodules, are dispersed on ocean bottom carries apparatus utilizing power from towed motion, hydraulic suction and vehicle-borne motor for acquiring, concentrating and transmitting desired aggregates to conduit for upward transport. Vehicle has motor-powered water impeller, ducting and nozzle for directing pressurized sheet-jet of water rearwardly downward near undersea floor, enclosed ramp inclined rearwardly upward with entrance behind sheet-jet to receive solids dislodged from sea floor by jet, hopper and trough to receive solids moved up ramp by flow of water up ramp when vehicle is towed forward, and separating screens and ducting to direct desired sizes of solids into conduit for delivery to surface ship. Operationally effective path can be widened with horizontally fenestrated sweeps disposed in rearwardly diverging and converging V-patterns.

9 Claims, 14 Drawing Figures

UNDERSEA MINING AND SEPARATING VEHICLE HAVING MOTOR-POWERED WATER JET

The present invention relates to obtaining solid minerals and more particularly to underwater mining.

Heretofore, desirable mineral aggregates have been found underwater, and many metallurgic and economic studies have indicated that substantial amounts of useful minerals are present as solid mineral aggregates, e.g., manganese nodules, on deep ocean floors. In many instances the aggregates are found dispersed over wide areas of the sea floor and although apparatus, such as suction conduits, have been devised for raising ore aggregates from the sea floor to a mining ship, there are needs for means to concentrate the dispersed, and desired, aggregates for efficient transportation up to the sea surface. Problems of providing an undersea mineral concentrator are made particularly difficult by the remoteness of the operation and the vastness of the ocean floor area and also by lack of precise knowledge of the features of the terrain that will be encountered in a specific operation, albiet some information obtained by geologic sampling and undersea television. Thus, an ocean floor vehicle must sustain happenstance encounter with very liquid soft areas, or viscous mud and sediment, or against hard unyielding obstructions. And solid materials may be encountered in forms of undesirably fine particles or practically untransportable large lumps.

It is desirable to prepare, for upward transport, a mineral concentration restricted to only the desired aggregates in order to avoid waste of transport energy and excessive pollution of the upper sea levels.

There has now been discovered an undersea minerals concentrating vehicle that enables providing concentrations of desired mineral aggregates for upward transport to mining ships.

It is an object of the present invention to provide a vehicle for undersea mining, Other objects and advantages of the invention will become apparent from the following description taken in conjunction with the accompanying drawing wherein.

Figure 1:
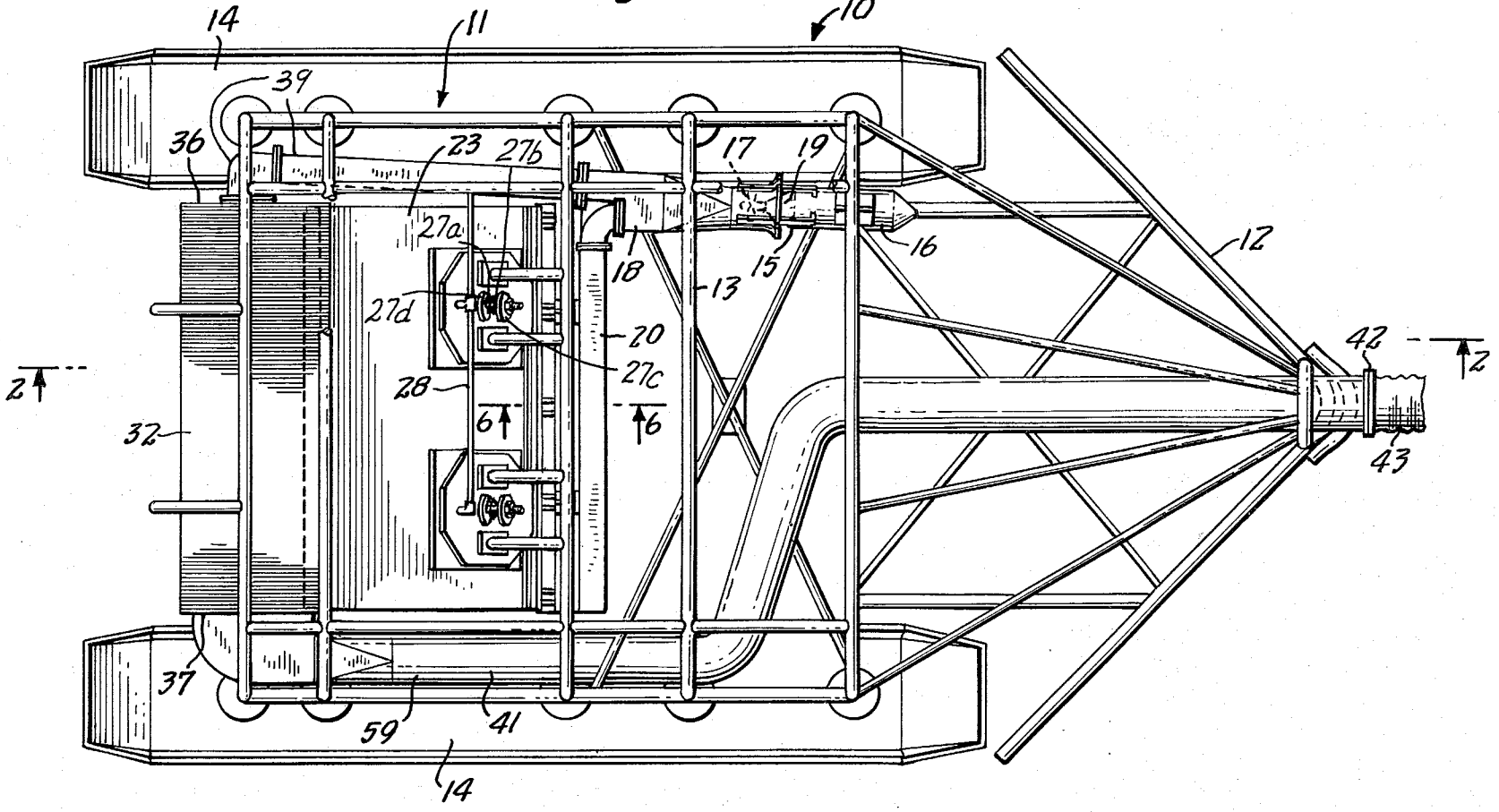
FIG. 1 is a plan view of an embodiment of the vehicle of the invention.
Figure 2:
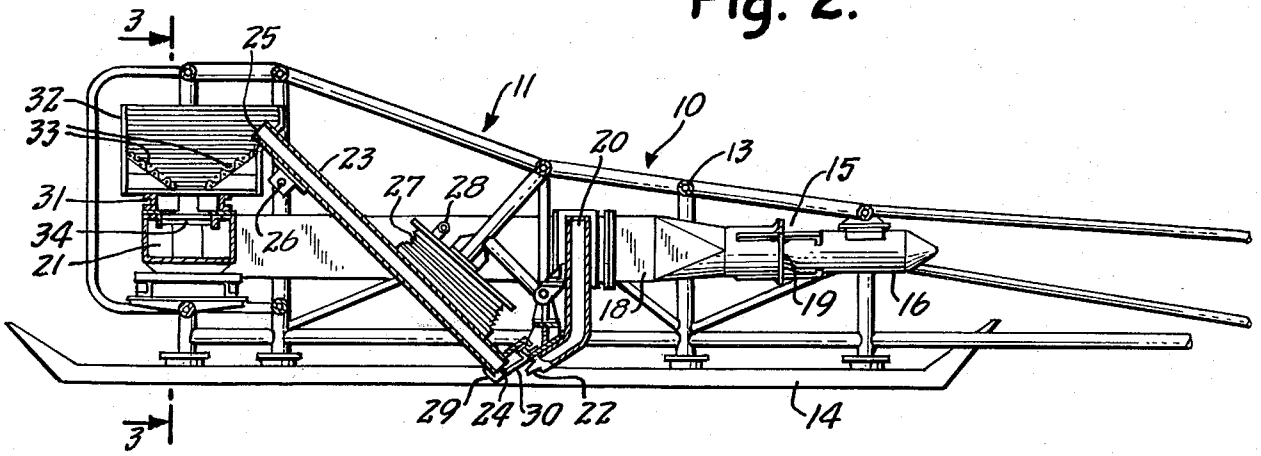
FIG. 2 is a view of a vertical longitudinal section on line 2—2 of FIG. 1.
Figure 3:
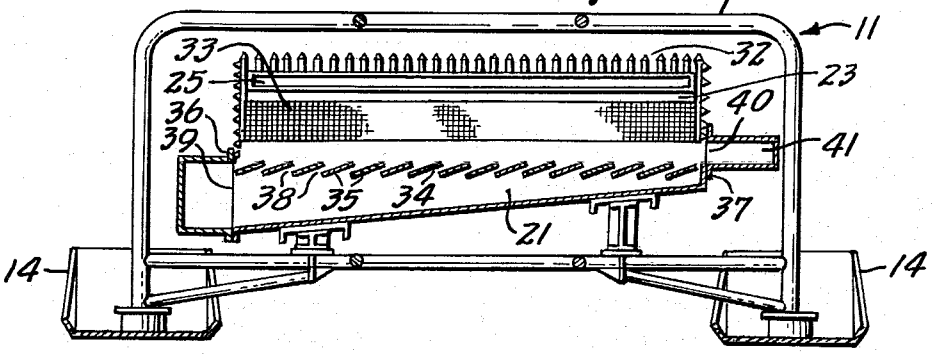
FIG. 3 is a view of a vertical cross section on line 3—3 of FIG. 2.
Figure 4:
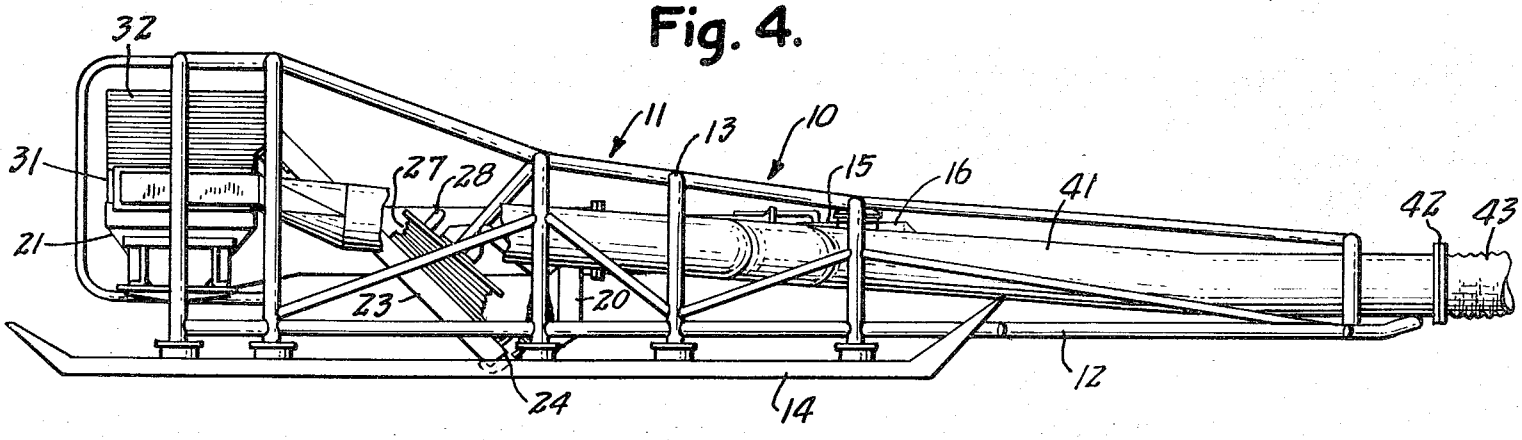
FIG. 4 is a side elevation view of the embodiment of FIG. 1.

The present invention contemplates an undersea mineral concentrator comprising a sliding vehicle structure that is adapted for being moved forwardly on the undersea floor and on which are mounted powered apparatus for directing a pressurized sheet-jet of water rearwardly downward near the sea floor and an enclosed ramp inclined rearwardly upward behind the jet, with the ramp entrance disposed to receive water and mineral aggregates driven by the jet. Aft of the ramp, the vehicle has a special hopper and trough arrangement for receiving solids from the top of the ramp and directing desired sizes through ducting to a delivery conduit, such as a suction riser, for conveyance by water flow to a collection station, e.g., a surface ship or floating platform. The top of the hopper has a fenestrated enclosure that retains desired sizes of solids in the vehicle and releases undesired fines from the vehicle while at the sea floor. The bottom of the trough, which is below the hopper, has orifices that direct a flow of clear water transversely up through the bottom of the trough and transversely across the vehicle to move desired sizes into conveyance and delivery ducting. Hydraulic flow in the sheet-jet and trough is forced by impeller and motor means, e.g., a water propeller and an electric or hydraulic motor, mounted on the vehicle. Advantageously, the vehicle also has wings of diverging and converging horizontally fenestrated sweeps for rejecting oversize solids, directing desired sizes toward the sheet-jet and discarding undesired fines.

In undersea mining operation, the jet nozzle and ramp and other apparatus of the vehicle are supported on sliding runners while moving forward over a sea floor having desired aggregates dispersed among other solids. The vehicle of the invention is specially advantageous for undersea concentration of mineral aggregates dispersed in areas where the sea floor has a surface layer of fine semi-fluid silt. The vehicle carries the ramp entrance close to, and generally only slightly above, the silt level of the floor. At the front of the ramp entrance, a wide sheet-jet of water from the nozzle forces a flow or water and sea floor solids, including desired aggregates, into and up the ramp. Barrier teeth at the ramp entrance reject oversize solids before entry into the vehicle. Accordingly, the vehicle takes in modest and small sizes of surface solids across a path that is the width of the jet nozzle and ramp, which are of the same width. Advantageously, the nozzle is slot-shaped or, if desired, the nozzle may be a row of orifices. Flow up the ramp can be assisted by secondary nozzles along the ramp. As solids move up and over the top of the ramp, desired sizes are retained in the vehicle and directed downward by a fenestrated enclosure, and much of the silt and other undesired fines is separated by exhausting through the fenestrations. The desired sizes are funneled down through a hopper and into a trough where a transverse flow of water from orifices in a pressurized duct at the trough bottom carries the desired sizes to a suction duct leading to a riser for upward conveyance. Tumbling action of the solids when moving through the ramp and hopper aids separation of desired sizes from silt and other undesired fines and is beneficial for cleaning the desired aggregates. Thus, the dispersion of desired aggregates in the mixture taken by the ramp is concentrated in the hopper and trough and the concentration of desired sizes, particularly including those suitable for commercial mineral processing and for conveying efficiently in a moving stream of water drawn up in a hydraulic suction conduit riser to a mining ship on the sea surface, e.g., aggregate lumps measuring about ⅛ inch to 2 inches, is transferred to a collecting station. Mining movement of the vehicle can be by towing with a conduit or cable connected to a surface ship. Power for hydraulic flow in the vehicle apparatus can be provided by means such as local storage batteries, riser energy extracted by turbines, surface unbilical-supplied hydrostatic power or surface unbilical-supplied electrical power.

The width of the path wherein aggregates are obtained and concentrated is increased in relation to the width of the jet and ramp with advantageous embodiments having horizontally fenestrated sweeps disposed in pairs of wings that, at the vehicle front, diverge away from the vehicle center line and reject oversize solids and that, behind the diverging rejection wings, converge toward the vehicle center line and direct desired sizes of solids toward the sheet-jet and the ramp entrance. The horizontally fenestrated sweeps provide a preconcentrated mixture at the mouth of the ramp. In certain specially advantageous embodiments that are particularly good for concentrating aggregates near the surface of a soft silt floor, the attachment of the converging sweep to the vehicle is vertically movable and enables the collecting wings to ride (or glide) along slightly under or above the silt line.

Figure 6:
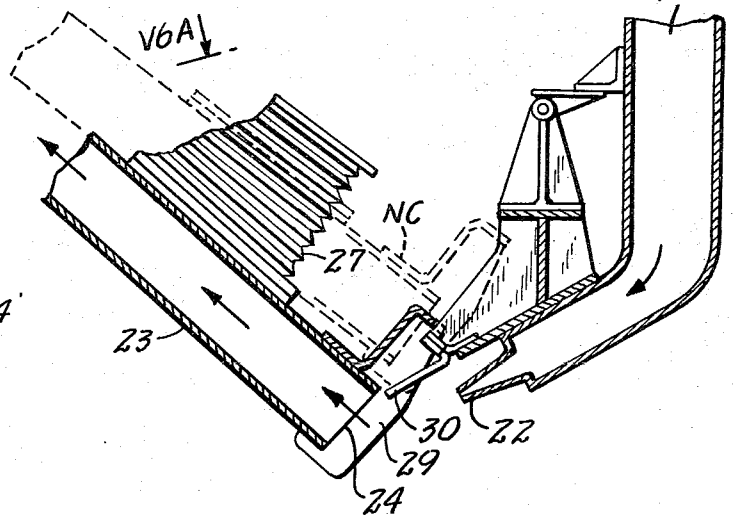
FIG. 6 is a detail view, of a portion of an enlarged scale, of a vertical longitudinal section on line 6—6 of FIG. 1.
Figure 5:
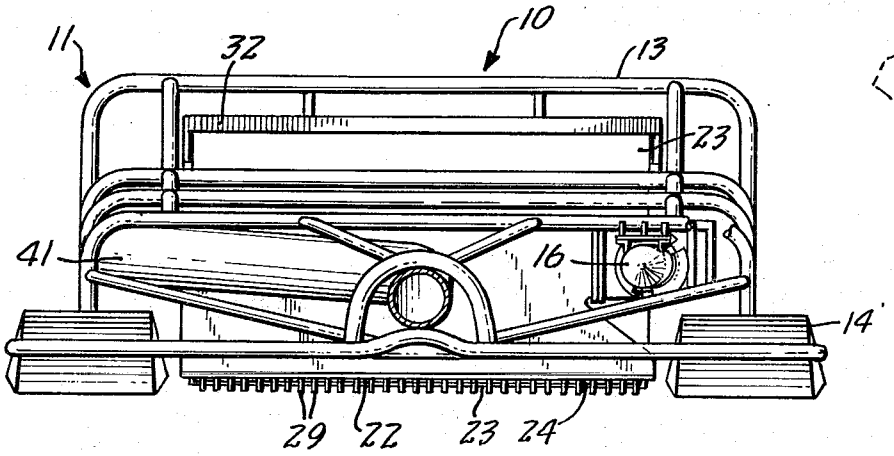
FIG. 5 is a front elevation view of the embodiment of FIG. 1.
Figure 7A:
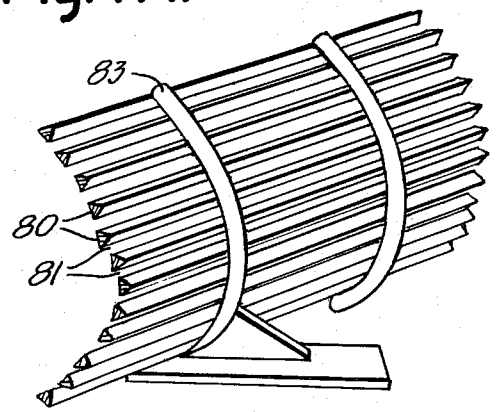
FIG. 7A is a perspective illustration of collection bars and an attached glider viewed from arrows V7A of FIG. 7.

Referring to FIGS. 1 to 6 and 6A, an advantageous embodiment of the mining vehicle of the invention is designated generally by the numeral 10. Vehicle structure 11 comprises obstacle avoidance bumper 12, support and roll bar framework 13 and two sliding runners 14 having ski-like ends. Hydraulic power unit 15, comprising electric motor 16 and propeller 17, is supported by the framework and connected to ducting 18 which conveys hydraulic flow driven by the power unit 15 from sea water entrance 19 to jet supply header 20 and to transverse trough 21. The header 20 distributes flow evenly to nozzle 22, which is adapted to emit a sheet-like (transversely wide and vertically thin) pressurized jet of water. Enclosed ramp 23 having entrance 24 and exit 25 is mounted with the exit end elevated by ramp pivot 26 and is spring-loaded biased toward rotation of the entrance end upward to a noncollecting position. On the drawing, the solid lines show the ramp 23 in the operating position for collection of minerals, and phantom line NC on FIG. 6 illustrates the noncollecting position. The collecting position is reached and maintained resiliently by inflation of activating bags 27 with pressurized water bled through tube 28 from the ducting. Conversely, the ramp entrance 24 can be raised to the noncollecting position by releasing pressure from the bags and permitting the spring-load bias of spring 27*a* coiled around shaft 27*b* between discs 27*c* and 27*d* to raise the entrance, thus discontinuing the taking of surface solids into the ramp.

The inlet end of the ramp 23 contains sizing teeth 29 to prevent oversized materials from entering the ramp enclosure. The sizing teeth can be cleared of jammed solids by raising the ramp entrance to move the sizing teeth 27 between comb-rake projections 30. When the ramp entrance 24 is in the noncollecting upper position, only water enters the system. Thus, by moving to the noncollecting position the collection function can be turned off during start up and shutdown of the mining system.

The nozzle 22 is arranged to direct the sheet-jet downwardly and rearwardly in front of the ramp entrance to dislodge solids from the sea floor and direct a flow of water and solids from the sea floor upwards through the ramp 23 as indicated by flow arrows on FIG. 6. Lateral extent of the nozzle 22 is the same as the lateral extent of the ramp opening, which is vertically larger than the nozzle opening, e.g., an 8 ft. by 4 inch ramp opening and an 8 ft. by ¾ inch nozzle opening.

Trough hopper 31 communicating with the ramp exit 25 has fenestrated cover 32 that enables exhaust of fine sediment and water from the ramp 23. Larger solids such as desired nodules that emerge from the ramp exit are dropped on screens 33 which funnel desired sizes down to open slatted floor 34 of the trough and release undersize particles. The trough floor 34 has slats 35 extending across the length of the trough from port entrance end 36 to starboard exit end 37. The slats are slanted transversely at small inclined angles, e.g., 10°, and disposed to provide small slot-shaped orifice openings 38 between the slats. The slat spacing is sufficient to enable passage of water, from trough flow supply duct 39, transversely and upwardly through exit trough 40 while retaining desired sizes above the trough floor 34 and enabling the hydraulic flow to carry desired sizes of solid matter into the trough exit 40 for transmittal into the conveyor duct 41. The conveyor duct transmits the hydraulic flow forward to conduit coupling 42 which provides for joining the vehicle ducting to riser 43 for carrying collected minerals up to a surface transport ship or other carrier.

Turning next to FIGS. 7 to 11, a particularly advantageous embodiment having two horizontally fenestrated sweeps is designated generally by numeral 70. Mining vehicle 70 includes support and roll bar framework 71, with bumper 72 and pavement rider 73, mounted on sliding runners 74 to enable moving the vehicle along ocean floor 75, e.g., by towing. Diverging horizontally fenestrated rejection sweep 76 comprises rejection bars 77 connected to the rider 73 and bumper 72 and oriented horizontally and divergent rearwardly away from the vehicle center line and which are vertically spaced apart to form mineral passage fenestrations 78 that are of a size sufficiently open for enabling passage of desired sizes of mineral aggregates and sufficiently closed for blocking passage of undesirably large aggregates or other large solids. Converging horizontally fenestrated collection sweep 79 comprises collection bars 80 which are oriented horizontally and convergent rearwardly toward the vehicle center line and are vertically spaced apart to form fines emission fenestrations 81 that are of a size sufficiently closed for preventing passage of desired sizes of aggregates while providing openings that enable passage of undesirably small particles and fine sediment for emission outward toward the rear of the vehicle. The rejection bars 72 are held by rejection bar supports 82, and the collecting bars 80 are held by curved external ribs 83 and wing padeyes 84, the bars being welded to the respective supports, ribs and padeyes. Referring to the plan view of FIG. 7, it is to be noted that the diverging sweep 76 extends rearwardly outward as a rearward open Vee, and the converging sweep 79 extends rearwardly inward and that wings 85 of the diverging rejection sweep 76 extend outward beyond the frontal opening of wings 86 of the converging collection sweep 79. It is further noted that from a cross-sectional viewpoint, the rejection bars 77 are disposed with the uppermost being the most forward and the retaining bars 80 are disposed in an inwardly concave structural pattern for benefiting collection of desired aggregates.

Figure 9:
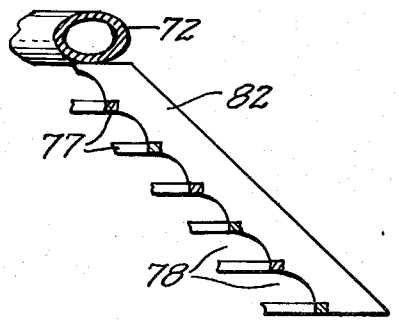
FIG. 9 is a detail view, on an enlarged scale, of a vertical cross section on line 9—9 of FIG. 7.
Figure 6A:
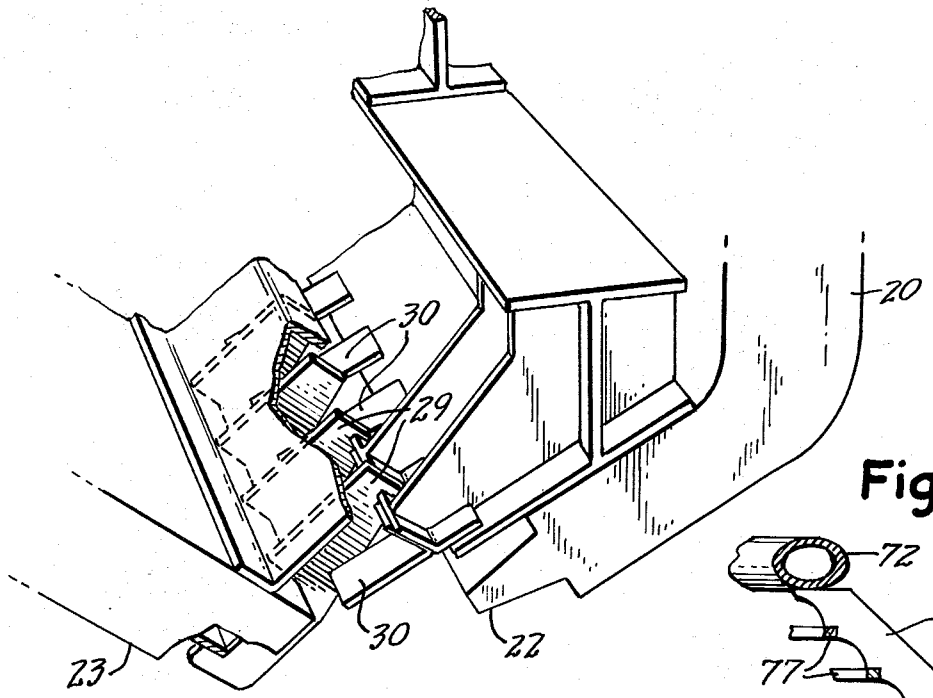
FIG. 6A is a perspective illustration of tooth and comb segments viewed from arrows V6A of FIG. 6.
Figure 7:
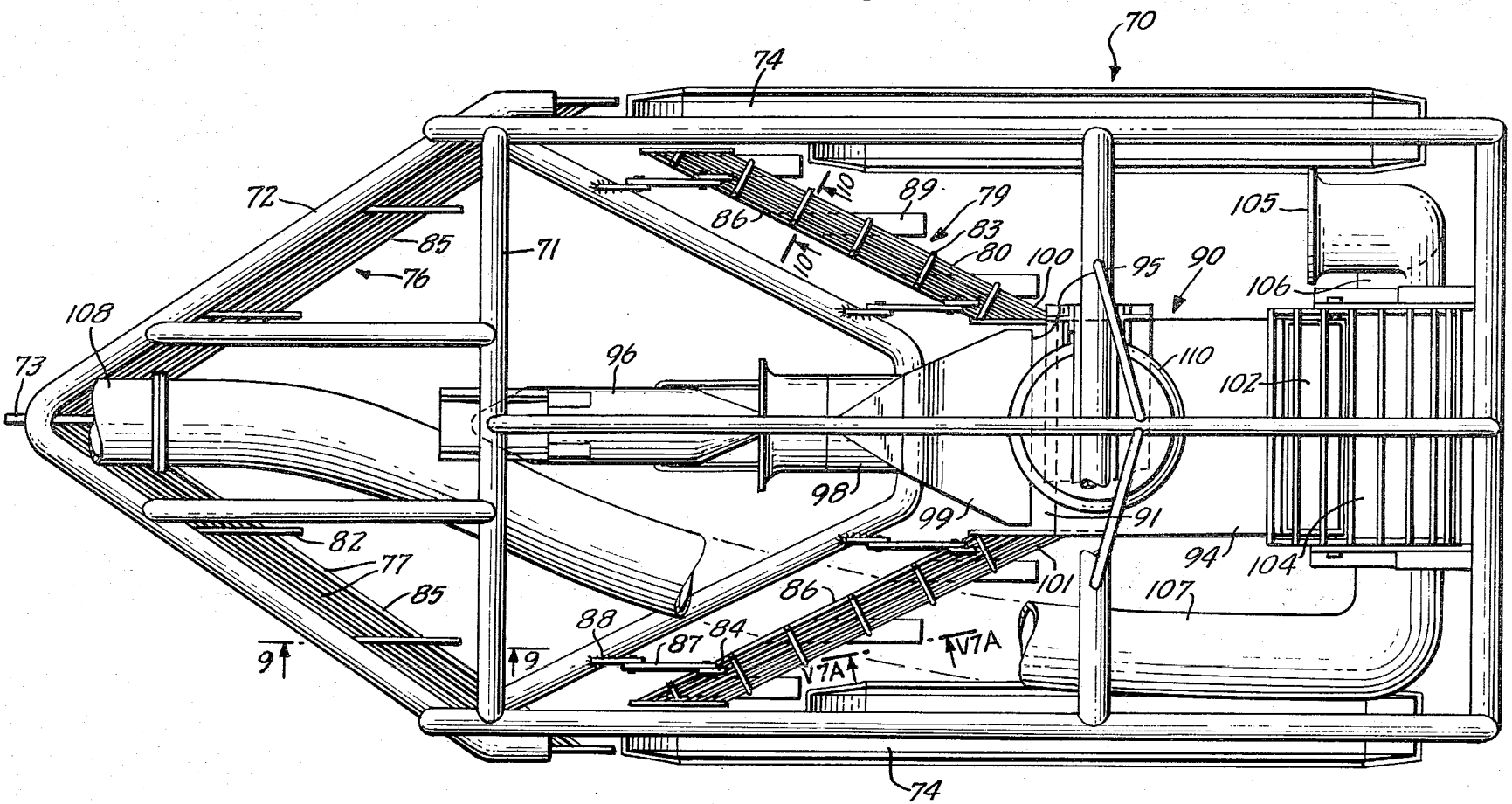
FIG. 7 is a plan view of another embodiment of the vehicle of the invention.
Figure 8:
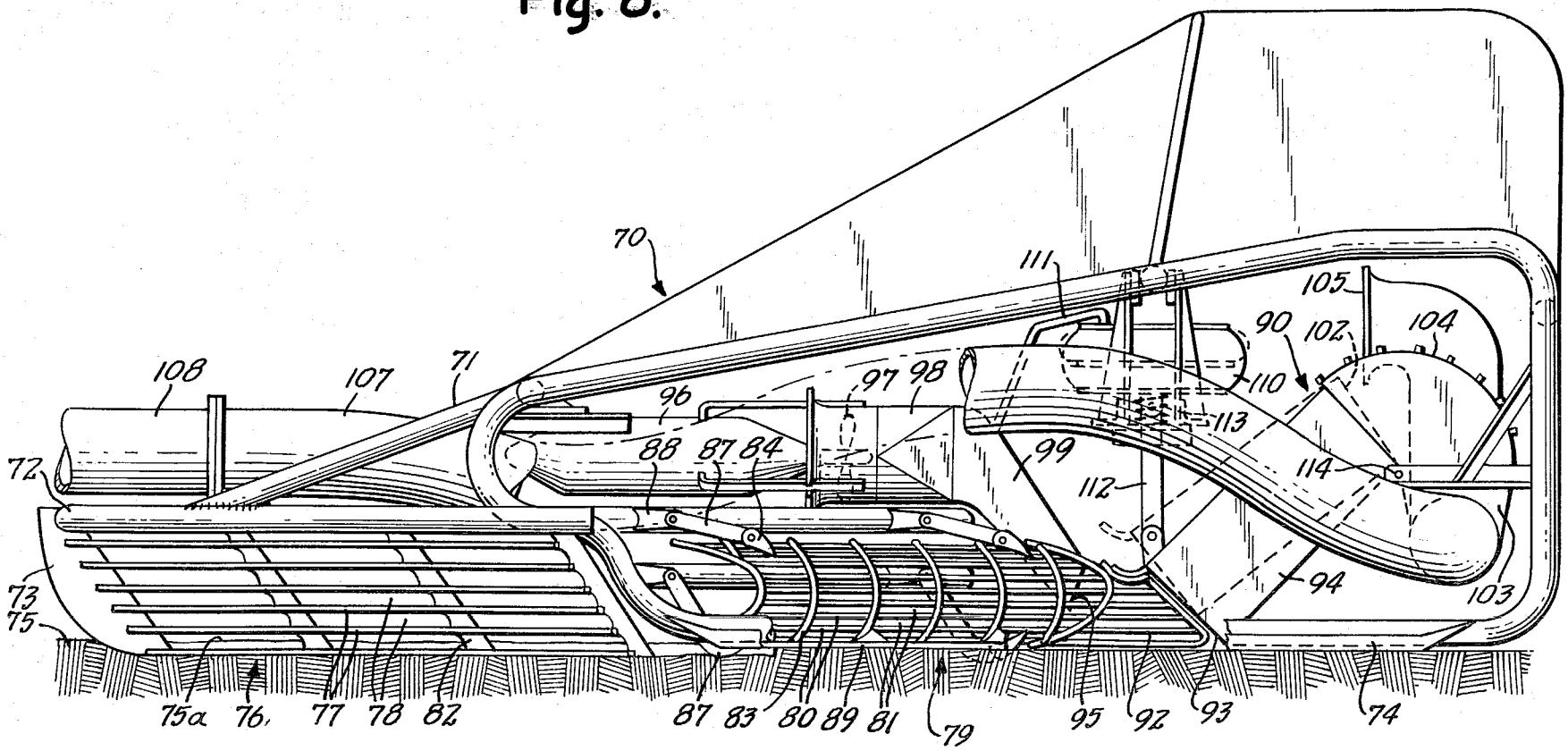
FIG. 8 is a side elevational view of the embodiment of FIG. 7.

A cross-section view of the bars 71 and fenestrations 78 in a wing of the rejection sweep is illustrated by FIG. 9.

Figure 11:
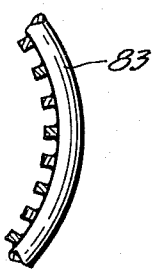
FIG. 11 depicts an illustrative alternate to the structure of FIG. 10.
Figure 10:
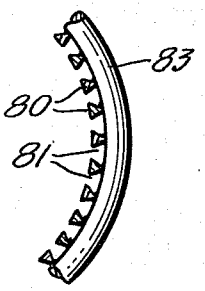
FIG. 10 is a detail view, on an enlarged scale, of a vertical cross section on line 10—10 of FIG. 7.

A cross-section view of the bars and fenestrations in a wing of the converging collection sweep, which has triangular wedge-wire retaining bars 80 with apexes pointed outwardly to provide rearwardly increasing fenestration spaces 81 is illustrated by FIG. 10. Also, FIG. 11 depicts another useable arrangement of retaining bars wherein the bars have rectangular cross-sections and, in view of the inwardly concave arrangement, the fenestrations between the bars increase rearwardly (and outwardly). The rearwardly increasing configuration is desirably provided to aid in preventing clogging of the fenestrations.

The collecting sweep wings 86 are pivotally connected to the vehicle framework 13 with arms 87 attached with pivot pins at each end in frame padeyes 88 and in the collecting wing padeyes 84 to enable vertical swinging of the arms 87 and thereby enable the collection wings, 86 which have attached thereto gliders 89, to move (or "float") up and down when the vehicle is passing over surface irregularities such as projections, depressions or soft spots of the undersea floor. With respect to this capability of the sweeping wings 86 to move vertically in relation to, and to a useful extent independently of, the horizontal path of the main frame on the outboard sliding runners 14, the movably connected collection sweep is referred to as a floating sweep. The floating action enables sweeping close to, above or below, the silt line (75*a*), aids in avoiding or overcoming forward build-up of excessive sediments in a bow wave and enables riding over hard projections. Where desired, the floating sweep can be mounted with a track and captive roller assembly, instead of the arm and padeye linkage, to enable the sweep to move up and down relative to the main frame structure.

When the vehicle is travelling over a sea floor of sediment, mud or the like in a region where mineral ores are present in modestly sized aggregates, such as manganese nodules dispersed at the floor surface, the forward movement of the diverging rejection sweep and the converging collection sweep when the vehicle is sliding forward with the runners on the sea floor surface provides a concentrated deposit of desired sizes of aggregates at the mouth of the power assisted concentrator-collector designated generally by numeral 90 at rear exit 91 of the collection sweep. There the concentrated deposit is directed aft by guidebars 92 into entrance 93 of enclosed ramp 94 and are moved up the ramp by water flow from sheet jet nozzle 95 aided by forward movement of the vehicle. Power for the water jet pressure is provided by electric motor 96 and propeller 97. Fan duct 98 and jet header 99, which serves as the nozzle support, lead the water flow from the propeller 97 and through the nozzle 95 to direct a jet sheet of water toward ramp entrance 93.

Both the jet sheet and the ramp entrance extend across the full width between the guidebars 92 at aft ends 100 and 101 of the collection sweep arms. The jet force, along with the forward movement of the vehicle through the sea water, drives the desired aggregates up the ramp 94 and through ramp exit 102 over hopper 103. Fenestrated diverter enclosure 104 over the ramp exit hopper 103 functions to divert desired sizes of aggregates downwards and into the hopper 103 while also exhausting dirt and sediment with overflow water, thus providing further concentration of desired sizes. A flow of water from sea water entrance 105 passes through hopper trough 106 under the hopper 103 and carries mineral aggregates from the hopper to riser duct 107 which transmits the minerals to riser 108 for transport to a surface ship.

For collection of aggregates the ramp entrance 93 is held in the collecting position near the sea floor by inflation of actuating bag 110 with water from pressure line 111. Actuating bag linkage 112 is spring-loaded upward with spring 113 to enable raising the ramp entrance 93 to the noncollecting position illustrated with phantom line outline by depressurizing the bag and rotating the ramp on pivot 114. The ramp entrance can have sizing teeth for aiding concentration by rejecting any oversizes passed by the rejection sweep, and comb projections for clearing the teeth when the ramp is raised can be mounted on the vehicle or guidebar frame.

The pressure and direction of the jet, the cross-sectional areas of the inlets, ducts and fenestrations are controlled in correlation with the riser suction to provide outward flow from the fenestrated diverter 104 and cross flow through the trough 106 and into the riser 108.

Figure 12:
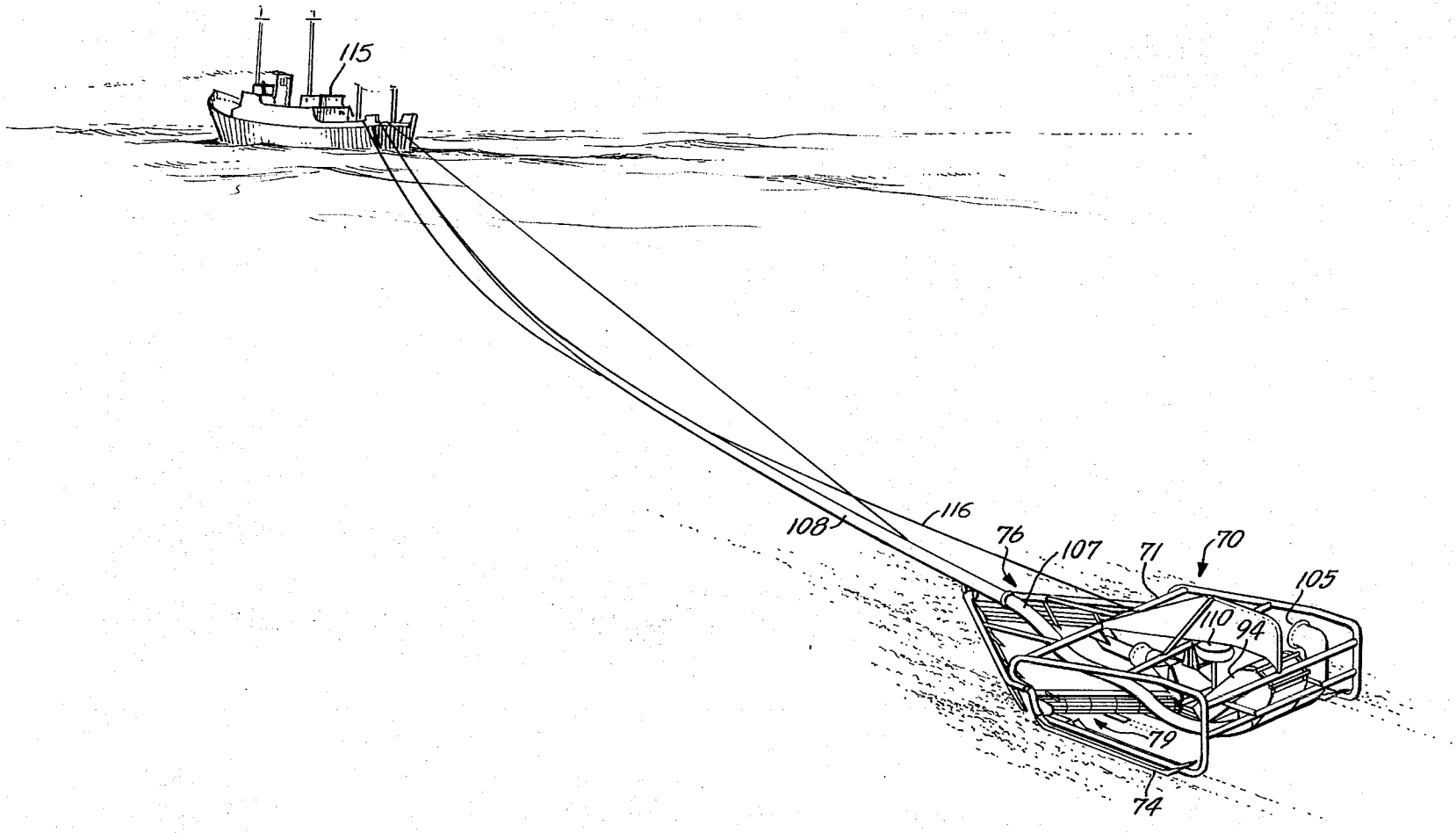
FIG. 12 is a perspective view illustrating an embodiment of the vehicle of the invention deployed for undersea mining in conjunction with a surface ship.

Proceeding to FIG. 12, vehicle 70 is illustrated deployed for mining on an undersea floor while being towed with the riser conduit 108 attached to surface ship 115. Electrical cable 116 transmits power from the surface ship 115 to the mining vehicle 70. Sea water is moved up the riser 106 by pumps supplied with power from the ship. Water flow up the riser moves the concentrated aggregates from the vehicle to the surface ship for storage and transport to land.

The present invention is particularly applicable to gathering and concentrating manganese nodules dispersed on deepsea floors under the ocean and is also applicable to obtaining and concentrating other mineral aggregates on underwater floors. Furthermore, for important matters of conservation and avoiding pollution of the natural environment, the invention provides beneficial advantages of enabling concentrating useful mineral aggregates for conveyance to the surface efficiently, and of avoiding wasting energy on upward conveyance of undesired silt and other solids, and of enabling discharging a major proportion or essentially all of the disturbed but unwanted solids from the vehicle while on the ocean floor, thereby restricting the amount of deepsea fines introduced into the upper regions of the sea. Moreover, it is meritorious that the vehicle avoids disturbing the ocean bottom in areas outside the collecting path of the vehicle and provides for avoiding disturbance of the sea floor when being moved on floor areas when collecting is not desired, for instance, by raising the ramp.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. An undersea mining vehicle for obtaining and concentrating desired sizes of mineral aggregates from a path of preselected width on an undersea floor area where desired aggregates are dispersed in a mixture with other solid materials at the surface of an undersea floor comprising:

a. a vehicle structure including a framework mounted on downward-facing supporting surfaces and adapted for being moved in a forward direction on a soft undersea floor;

b. a nozzle for directing a pressurized sheet-jet of water rearwardly downward, and extending laterally, near the sea floor when the downward facing surfaces are supported by the sea floor;

c. an enclosed ramp inclined rearwardly upward and adapted to be disposed with the ramp entrance behind the jet and at least as high as the level of the downward-facing supporting surfaces and in a collecting position for receiving water and sea floor solids, including desired sizes of mineral aggregates, driven by the jet;

d. means for maintaining the ramp entrance at least as high as the level of the downward-facing supporting surfaces;

e. a hopper disposed behind the ramp and adapted for receiving desired aggregates from the ramp exit and directing desired aggregates to fall downward and also having opening for exhausting undesired fine solids out of the vehicle;

f. a trough below the hopper, said trough being adapted to receive aggregates falling from the hopper and to receive and direct a flow of water transversely to the flow of aggregates falling from the hopper;

g. a conveyance duct to carry a flow of water and aggregates from the trough to a place where delivery of aggregates is desired; and h. hydraulic pressurizing means and ducting for providing pressurized flows of water through the sheet-jet nozzle and through the trough.

2. A vehicle as set forth in claim 1 whereon the lateral extent of the sheet-jet nozzle is at least equal to the width of the preselected path.

3. A vehicle as set forth in claim 1 whereon the vehicle structure includes two sliding runners adapted for providing the downward-facing supporting surfaces.

4. A vehicle as set forth in claim 1 whereon the hydraulic pressurizing means for providing a pressurized flow of water through the sheet-jet comprises a motor-driven impeller and ducting for conveying a pressurized flow of water from the impeller to the sheet-jet nozzle.

5. A vehicle as set forth in claim 1 whereon the hopper has a fenestrated cover adapted for directing the flow of desired aggregates downward and having opening for exhausting undesired fines outward from the vehicle.

6. A vehicle as set forth in claim 1 whereon the trough has orifices adapted for directing a flow of water along the trough floor.

7. A vehicle as set forth in claim 1 whereon the means for maintaining the ramp entrance at least as high as the level of the downward facing surfaces includes a spring for raising the ramp entrance up from the collecting position to a noncollecting position and hydraulic pressure means for lowering the ramp entrance down from a noncollecting position to the collecting position.

8. An undersea mining vehicle for obtaining and concentrating desired sizes of mineral aggregates from a path of preselected width on an undersea floor area where desired aggregates are dispersed in a mixture with other solid materials at the surface of an undersea floor comprising:

a. a vehicle structure including a framework mounted on downward-facing supporting surfaces and adapted for being moved in a forward direction on a soft undersea floor;

b. a nozzle for directing a pressurized sheet-jet of water rearwardly downward, and extending laterally, near the sea floor when the downward facing surfaces are supported by the sea floor;

c. an enclosed ramp inclined rearwardly upward and adapted to be disposed with the ramp entrance behind the jet and at least as high as the level of the downward-facing supporting surfaces and in a collecting position for receiving water and sea floor solids, including desired sizes of mineral aggregates, driven by the jet;

d. means for maintaining the ramp entrance at least as high as the level of the downward-facing supporting surfaces;

e. a hopper disposed behind the ramp and adapted for receiving desired aggregates from the ramp exit and directing desired aggregates to fall downward and also adapted for exhausting undesired fine solids out of the vehicle;

f. a trough below the hopper, said trough being adapted to receive aggregates falling from the hopper and to receive and direct a flow of water transversely to the flow of aggregates falling from the hopper;

g. a conveyance duct to carry a flow of water and aggregates from the trough to a place where delivery of aggreages is desired;

h. hydraulic pressurizing means and ducting for providing pressurized flows of water through the sheet-jet nozzle and through the trough;

i. a rearwardly diverging horizontally fenestrated rejection sweep rigidly fixed to the vehicle framework and disposed at the front of the vehicle, said rejection sweep comprising two rejection wings having rejection bars and rejection bar supports joined with the rejection bars supported horizontally and spaced apart sufficiently to permit passage of desired aggregate sizes and to reject passage of undesired large sizes, said rejection wings being fixed to the vehicle structure in the configuration of a rearwardly diverging Vee; and j. a rearwardly converging horizontally fenestrated collection sweep disposed behind the rejection sweep, said collection sweep comprising two collection wings having collection bars and ribs holding the collection bars horizontal and spaced apart sufficiently to permit passage of undesired fine particles and to prevent passage of desired sizes, said collection wings being connected to the vehicle structure with a vertically movable attachment holding the collection wings in the configuration of a rearwardly converging Vee with a forward opening extending across at least a portion of the width of the aft opening of the rejection sweep Vee and with a rearwardly open exit at the apex of the collection Vee disposed in front of the sheet-jet nozzle.

9. A vehicle as set forth in claim 8 whereon the width of the forward opening of the collection sweep Vee is equal to the width of the preselected path and whereon the lateral extent of the sheet-jet nozzle is at least equal to the width of the converging collection sweep exit.

* * * * *

UNITED STATES PATENT OFFICE
CERTIFICATE OF CORRECTION

PATENT NO. : 3,975,054

DATED : August 17, 1976

INVENTOR(S) : FRANK HOWARD BROCKETT, III, JAMES E. PHILP & ARTHUR FRANCIS SULLIVAN

It is certified that error appears in the above-identified patent and that said Letters Patent are hereby corrected as shown below:

Column 1, line 55, for "of", second occurrence, read --on--.

Column 2, line 49, for "or" read --of--.

Column 3, line 68, for "27" read --29--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*